United States Patent [19]

Fisher

[11] Patent Number: 4,895,143

[45] Date of Patent: Jan. 23, 1990

[54] MOUTHPIECE

[75] Inventor: Joseph A. Fisher, 113 Franmore Cir., Thornhill, Ontario, Canada, L4J 3B9

[73] Assignee: Joseph A. Fisher, Thornhill, Canada

[21] Appl. No.: 135,987

[22] Filed: Dec. 21, 1987

[30] Foreign Application Priority Data

Mar. 16, 1987 [CA] Canada ..... 532,083

[51] Int. Cl.[4] ..... A62B 18/08

[52] U.S. Cl. ..... 128/206.29; 128/206.28

[58] Field of Search ..... 128/206.16, 206.29, 128/207.14, 720, 206.28

[56] References Cited

U.S. PATENT DOCUMENTS

| | | | |
|---|---|---|---|
| 893,213 | 7/1908 | Whiteway | 128/206.16 |
| 2,521,084 | 9/1950 | Oberto | 128/206.29 |
| 2,708,932 | 5/1955 | Pipher | 128/206.16 |
| 3,930,507 | 1/1976 | Berman | 128/207.14 |
| 4,326,416 | 4/1982 | Fredberg | 128/720 |
| 4,640,273 | 2/1987 | Greene et al. | 128/207.14 |

*Primary Examiner*—Edgar S. Burr
*Assistant Examiner*—Aaron J. Lewis
*Attorney, Agent, or Firm*—Ivor M. Hughes

[57] ABSTRACT

A mouthpiece through which a person may breathe has a sealing flange for introduction into the mouth. The sealing flange has an upper portion for lying against the hard palate and a lower portion for fitting between the lower lip and the anterior surface about the lower teeth and gums. The juxtaposition in the mouth of the upper portion against the hard palate and the lower portion seated in the lower vestibule portion of the mouth results in the sealing flange forming an effective seal and the sealing flange being comfortably held in place in the mouth even when the mouth is open to the extent of the normal relaxed muscle tone of the mouth. To facilitate the seal when the mouthpiece is introduced into the mouth, a tooth tray is provided. Another aspect of the invention permits the mouthpiece to envelop the nostrils such that when the mouthpiece is in place all inspired and expired air must pass through the mouthpiece. In the best embodiment of the invention, the nostrils are enveloped by a naso-labial hood which envelops the entire nose forming a seal against the outline of the nose, thereby minimizing the non-respiratory tract dead air space inside the volume of the naso-labial hood.

15 Claims, 7 Drawing Sheets

MOUTHPIECE

FIELD OF INVENTION

This invention relates to an improved device through which gas entering and leaving the respiratory system of a person may pass, and in one aspect is adapted to provide a mouthpiece which will control all the gas entering or leaving the mouth. In another aspect, this invention relates to a device which will control all the gas entering or leaving the mouth and nostrils.

BACKGROUND OF INVENTION

A variety of devices have been taught for controlling the communication of gas entering and leaving the respiratory system. For example, for supplying gases other than those present in the ambient environment, to modify the ambient environment or for collecting exhaled gases for testing.

This can be done by covering the head with a hood-like device, or by covering the whole face or just the mouth and nose with a mask or by directing gas flow through the mouth by means of a mouthpiece.

A mouthpiece to function as a conduit for gases to and from the lungs has features which are intended to (a) hold it in place, (b) effect a seal to ensure all gases passing the mouth can only pass through the mouthpiece. In cases where it is desired to have control of all of the gases entering or leaving the respiratory system, features must be incorporated to either block the nose or collect all gases passing through the nose as well.

U.S. Pat. No. 1,050,620 to De Ford teaches a mouthpiece having a tube of oval cross section for introduction between the teeth to act as an air passage as well as to hold the mouthpiece in place. U.S. Pat. No. 2,521,084 to Oberto teaches a tray following the contour of the teeth. This tray is used to hold the mouthpiece in place as well as to keep the teeth apart and thus prevent obstruction of the internal opening of the mouthpiece's air passage. U.S. Pat. No. 1,592,345 to Drager teaches a mouthpiece held in place by the teeth which are wedged between a flared section of the mouthpiece on their labial side and a different flared section on their lingual side. U.S. Pat. No. 3,207,154 to Rubilotta teaches two wedge shaped projections from the mouthpiece designed to fit between the teeth for the purpose of stablization of the mouthpiece and to separate the teeth to allow free passage of air through the mouthpiece. De Ford and Drager also teach head harness and neck straps to hold the mouthpiece in place.

Holding the mouthpiece in place by use of the teeth has some disadvantages. Holding the mouth open for more than a few minutes is very uncomfortable. It is very difficult to swallow with the mouth open. On the other hand loosening the force on the mouthpiece or opening the mouth may lead to loss of seal of the mouthpiece or its dislodgement from the mouth. Straps prevent rapid engagement and disengagement of mouthpiece and would make it unsuitable for most uses.

De Ford effects a seal by means of an inflatable flange surrounding the mouth. U.S. Pat. No. 4,030,493 to Walters teaches effecting a seal by means of an oval flange that is held to the mouth by hand when the mouthpiece is in the mouth. U.S. Pat. No. 4,470,413 to Warncke teaches the internal opening to the mouthpiece is surrounded by an oval flange that fits around the inside of the mouth opening between the lips and the teeth.

These seals require constant effort and attention for effectiveness.

U.S. Pat. No. 4,470,413 to Warncke teaches a mask attachment to the mouthpiece which blocks the nose when the mouthpiece is in place. U.S. Pat. No. 2,521,084 to Oberto teaches a mask covering the nose forming a common gas passage between the mouthpiece and the nose. The mask is held in place by the mouthpiece which in turn is held in place by the teeth, putting further stress on the jaw muscles. Further, the mask has a large non-respiratory tract dead air space, which is not desirable for the collection of test gases.

It is therefore an object of this invention to provide an improved device through which a person may breathe through the mouth.

It is a further object of this invention to provide an improved device through which a person may breathe through both the mouth and nostrils.

It is a further object of this invention to provide an improved device through which a person may breathe through either the mouth or in another aspect through both the mouth and nostrils, which forms a more effective and comfortable seal with the mouth or the mouth and nostrils, and may be held in place sufficient to form an effective seal without the use of straps or the necessity of a person gripping the device with the teeth.

Further and other objects of the invention will be apparent of those skilled in the art from the following summary of the invention and detailed description thereof.

SUMMARY OF INVENTION

According to one aspect of the invention there is provided a mouthpiece through which a person may breathe comprising a manifold having at least one first opening in the manifold, the manifold at the first opening extending to form a sealing flange for introduction into the mouth, the sealing flange comprising an upper portion of palatine hood and a lower portion or lower labial skirt, the palatine hood of a generally convex shape suitable to lie against the hard palate and the posterior side of the upper teeth extending laterally in both directions from proximate the central incisors to proximate the premolars inside the buccal cavity, the lower labial skirt of a generally concave shape suitable to lie between the posterior face of the lower lip and the anterior face of the lower gum and teeth extending laterally in both directions from proximate the central incisors to proximate the premolars inside the lower vestibule portion of mouth; the manifold having at least a second opening for opening outside the mouth for the passage of inspired and expired air, the first opening and the second opening being in communication with one another through the manifold for the passage of air.

According to this aspect of the invention for retaining a mouthpiece in the mouth of a person to provide a good seal when the sealing flange is introduced into the mouth of a person for the passage of air, the general configuration of the sealing flange in such that the sealing flange comprises an upper palatine hood the peripheral shape of which extends laterally from about its centre angularly downward on both sides to its lateral limits where it merges on both sides with the lateral limits of the lower labial skirt, the peripheral shape of the lower labial skirt extending laterally from about its centre upwardly to merge with the palatine hood such that the two laterally spaced areas of merger between the palatine hood and the lower labial skirt are at about the corners of the mouth when the sealing flange is introduced into the mouth. The shape of the sealing flange allows the mouthpiece to stay in the mouth when the mouth is open to the exent of the normal relaxed muscle tone of the mouth and lips, as a result of the sealing flange extending from proximate the hard palate to proximate the base of the lower vestibule portion of the mouth. Advantageously a person may close the mouth completely or open the mouth to a comfortable degree and still maintain the mouthpiece in place providing an effective seal and stability in the mouth.

According to a preferred embodiment of the invention the sealing flange comprising an upper palatine hood the peripheral shape of which extends from about its centre angularly downward on both sides to its lateral limits where it merges, on both sides with the lateral limits of the lower labial skirt, the peripheral shape of the lower labial skirt extending laterally from about its centre upwardly to merge with the palatine hood; comprises at about the two laterally spaced areas of merger between the palatine hood and the lower labial skirt and extending across the lateral width of the sealing flange, a tooth tray for extending under the upper teeth and merging with the upper palatine hood suitable to facilitate a seal proximate the upper portion of the mouth and to permit the mandible to close without displacing tissue or forcing the mouth open. Preferably, the thickness of the said tooth tray does not exceed about 0.5 millimeters.

According to another aspect of the invention there is provided a breathing apparatus comprising a manifold having at least one first opening in the manifold, the manifold at the first opening extending to form a sealing flange for introduction into the mouth, the sealing flange comprising an upper portion or palatine hood and a lower portion or lower labial skirt, the palatine hood of a generally convex shape suitable to lie against the hard palate and the posterior side of the upper teeth extending laterally in both directions from proximate the central incisors to proximate the premolars inside the buccal cavity, the lower labial skirt of a generally concave shape suitable to lie between the posterior face of the lower lip and the anterior face of the lower gums and teeth extending laterally in both directions from proximate the central incisors to proximate the premolars inside the lower vestibule portion of the mouth; at least a second opening in the manifold for opening outside the mouth for the passage of inspired and expired air, the first opening and the second opening being in communication with one another for the passage of air; and, at least a third opening in the manifold for the passage of air between the manifold and a naso-labial hood for enveloping the nostrils, the naso-labial hood presenting a generally concave cavity to envelop the nose and of a peripheral shape to lie against the outline of the nose comprising the nasal bony cartilage, the nasal bone, and the maxillary soft tissue on both sides of the nose downwardly to the anterior face of the upper lip below the nostrils. Advantageously, the naso-labial hood provides a minimal volume of non-respiratory tract dead air space. Preferably the naso-labial hood is integrated with the palatine hood through the body of the breathing apparatus to provide an elastic recoiling between the naso-labial hood and the palatine hood sufficient for the device to form a compressive grip about the soft tissue defined on one side by the exterior surface of the nose including the nasal bony cartilage, the nasal bone, the maxillary soft tissue on both sides of the nose downwardly to the anterior face of the upper lip and, defined on the opposing side by the hard palate supported by the maxillary bone.

According to a preferred embodiment of the invention the naso-labial hood and the palatine hood are integrated to establish a compressive elastic recoiling between the two by means of a resiliently deformable frame integrated into the breathing apparatus. In a preferred embodiment the resiliently deformable frame may comprise a compressively sprung clip formed of any suitable material such as steel integrated into the body of the naso-labial hood, manifold, and palatine hood to form opposing compressively sprung arms of the clip in the naso-labial hood and palatine hood sufficient to cause the naso-labial hood and the palatine hood to recoil one towards the other.

DETAILED DESCRIPTION OF PREFERRED EMBODIMENTS OF THE INVENTION

Figure 1:
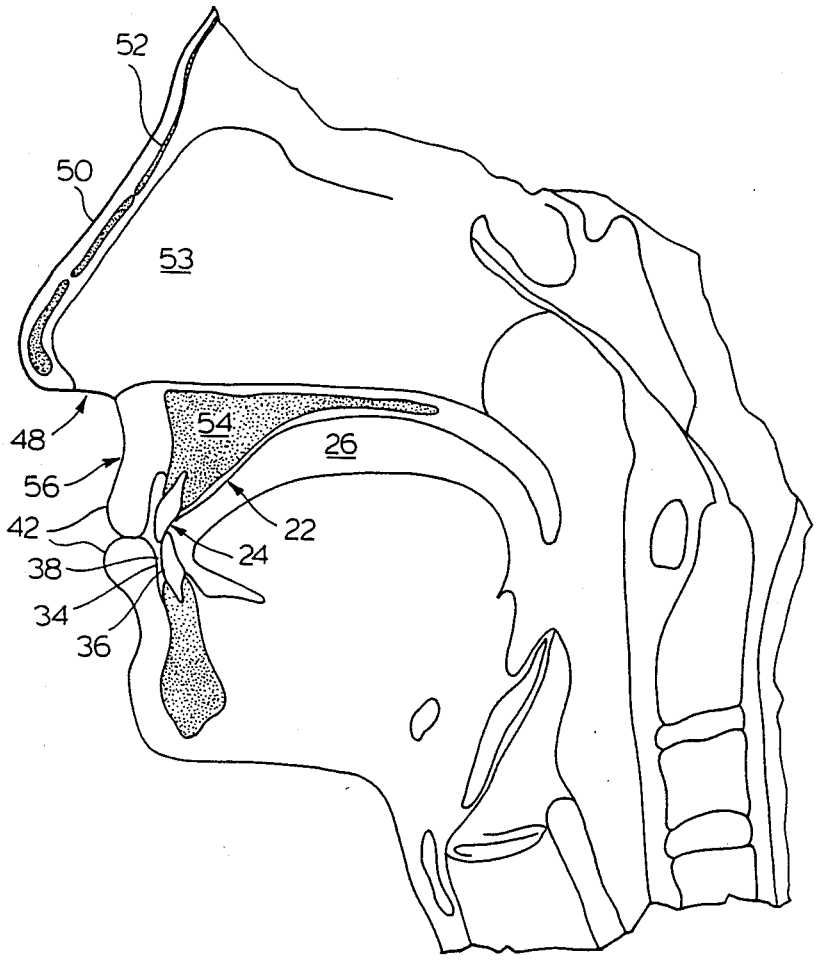
FIG. 1 is a sagital section of a portion of a human head.
Figure 3:
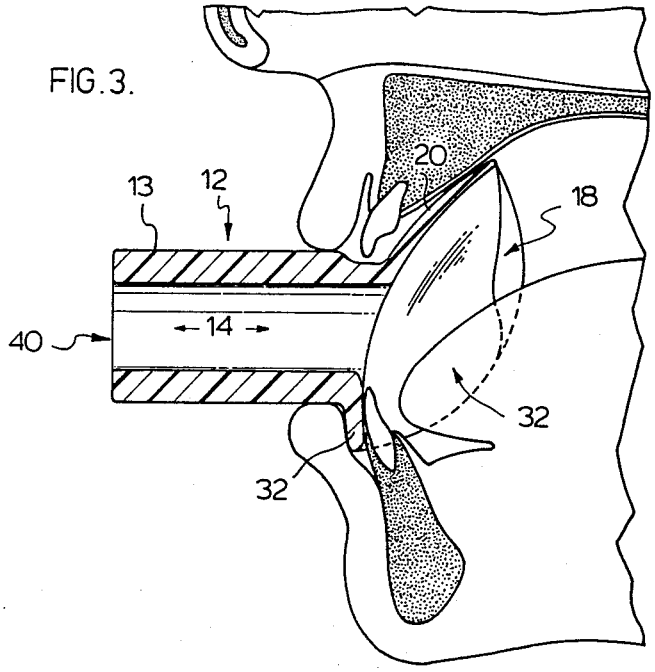
FIG. 3 is a side view of the mouthpiece in FIG. 2, shown partially in longitudinal section.

With reference to FIGS. 2, 3, 5, 6, and 7 there is shown a mouthpiece 12 through which a person may breathe. The mouthpiece comprises a manifold 13 defining a chamber volume 14 (best seen in FIG. 3) for the passage of air. At least one first opening 16 (best seen in FIG. 7) in the manifold 13 for opening outwardly to form a sealing flange 18 for introduction into the mouth is provided. The sealing flange 18 comprises a palatine hood 20 of a generally convex shape suitable to lie congruently against the hard palate 22 and the posterior side of the upper teeth 24 extending laterally from the incisors to the premolars inside the buccal cavity 26, a bite plate 28 of about less than 0.5 mm thick for opposition to the upper teeth 30; and, a lower labial skirt 32 of a generally concave shape suitable to lie between the posterior face of the lower lip 34 and the anterior face of the lower gum and teeth 36 extending laterally from the incisors to the premolars inside the lower vestibule portion 38 of the mouth.

A second opening 40 (best seen in FIGS. 2, 3, 4, and 8) in the manifold 13 is in communication with the first opening 16 for the passage of air through the chamber volume 14 defined by the manifold 13.

Figure 2:
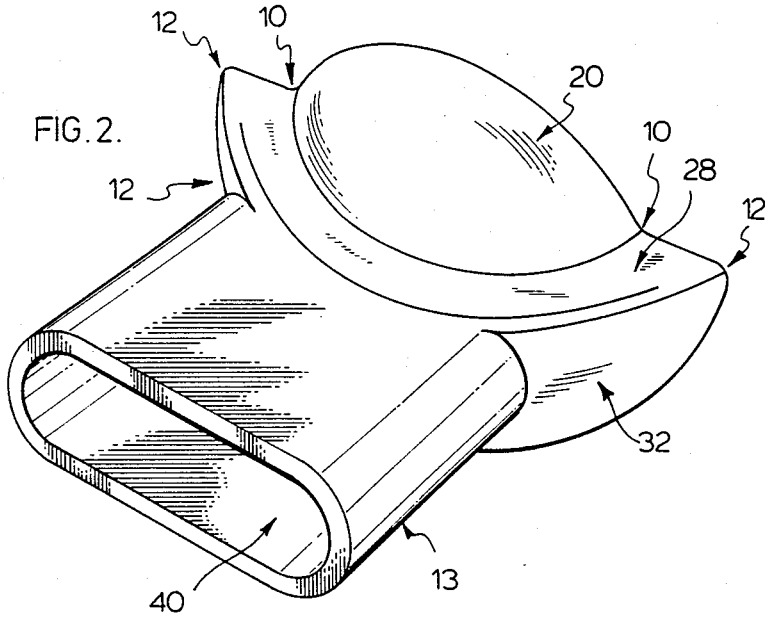
FIG. 2 is a perspective view of a mouthpiece through which a person may breathe through the mouth.
Figure 4:
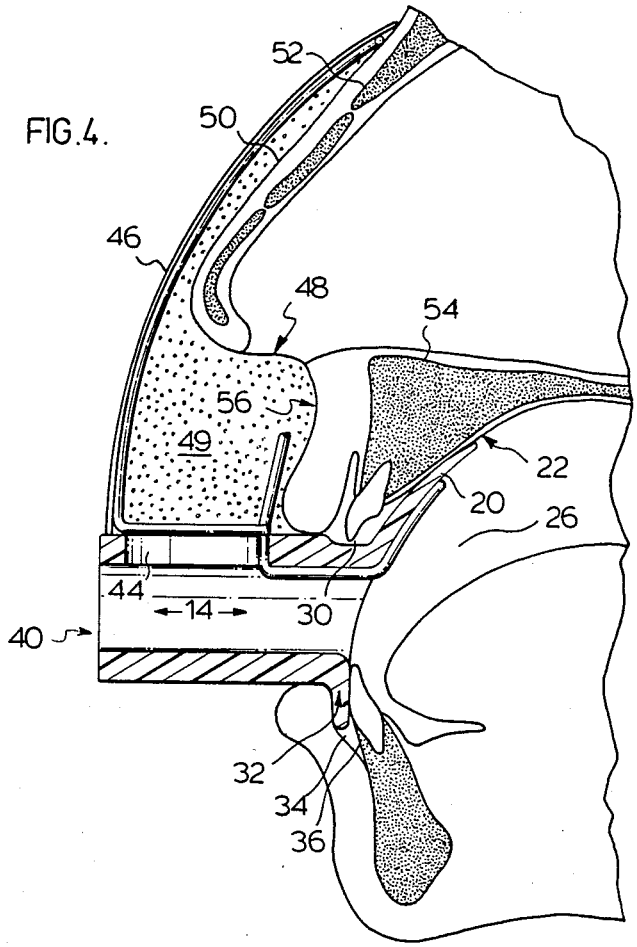
FIG. 4 is a sagital section of a portion of the human head shown in FIG. 1 with the mouthpiece comprising a naso-labial hood shown in FIG. 8 inserted in the mouth and enveloping the nostrils.
Figure 5:
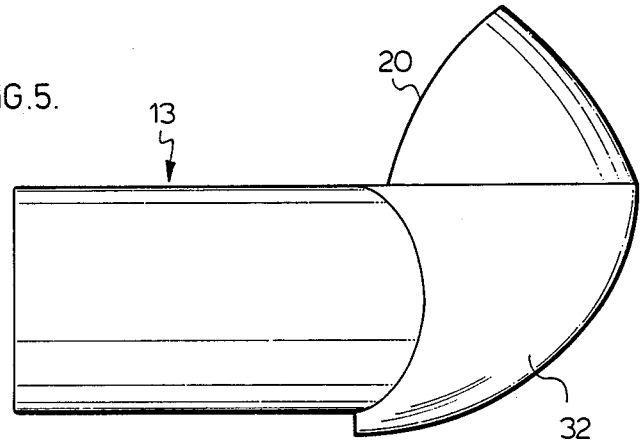
FIG. 5 is a side view of the mouthpiece in FIG. 2.
Figure 6:
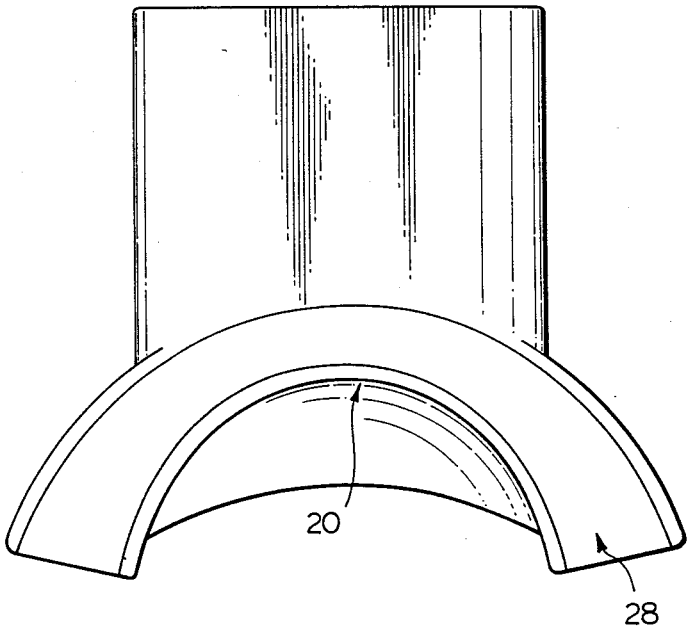
FIG. 6 is a top view of the mouthpiece in FIG. 2.
Figure 7:
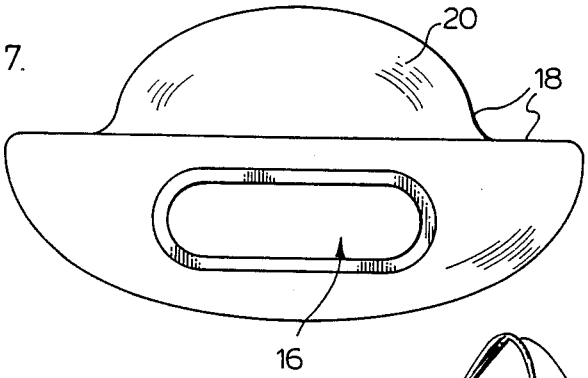
FIG. 7 is an end view of the end of the mouthpiece in FIG. 2 which is to be inserted in the mouth.

Referring to FIGS. 2 and 4 the general configuration of the sealing flange 18 is such that the lateral limits 70 of the palatine hood 20 merge substantially with the lateral limits 72 of the lower labial skirt 32, sufficient that when the sealing flange 18 is introduced into the buccal cavity 26 and the lower vestibule portion 38 of the mouth the lateral limits 70, 72 of the sealing flange 18 extend to about the corners 74 of the mouth. When the mouthpiece 12 (as seen for example in FIG. 4) is introduced into the buccal cavity 26 and lower vestibule portion 38 of the mouth, and the mouth is opened to the extent of the normal relaxed muscle tone of the mouth and lips 42 surrounding the sealing flange 18, the mouthpiece stays in the mouth as a result of the sealing flange 18 extending from proximate the hard palate 22 to proximate the base of the lower vestibule portion of the mouth 38.

Figure 8:
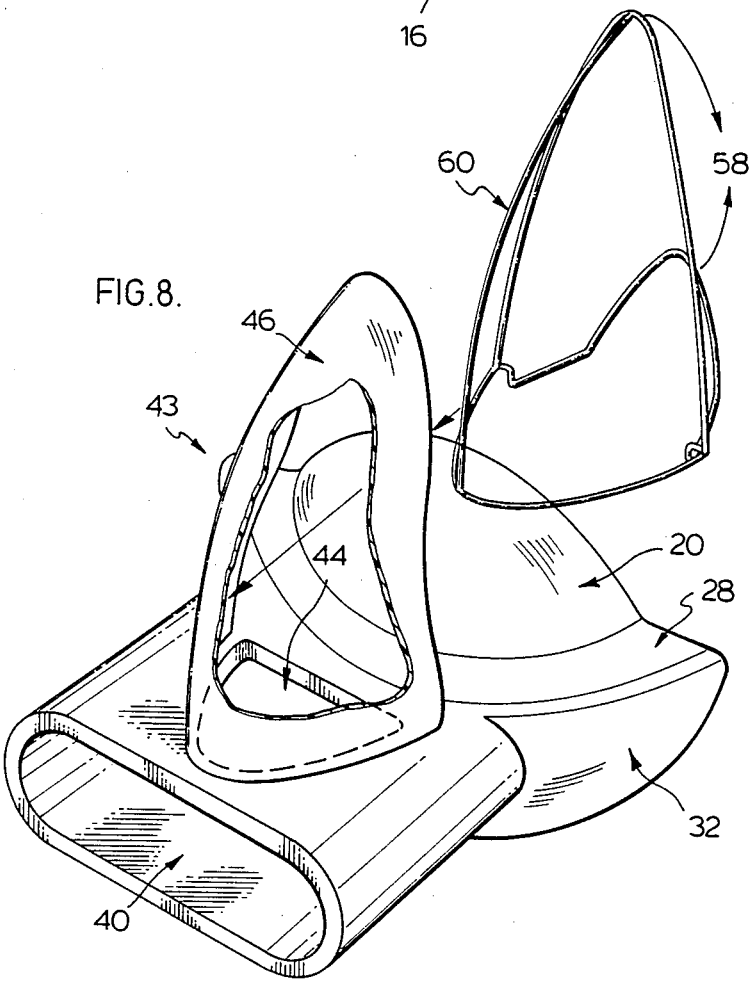
FIG. 8 is a perspective view, in which some of the elements are in exploded view, of a mouthpiece comprising a naso-labial hood.
Figure 9:
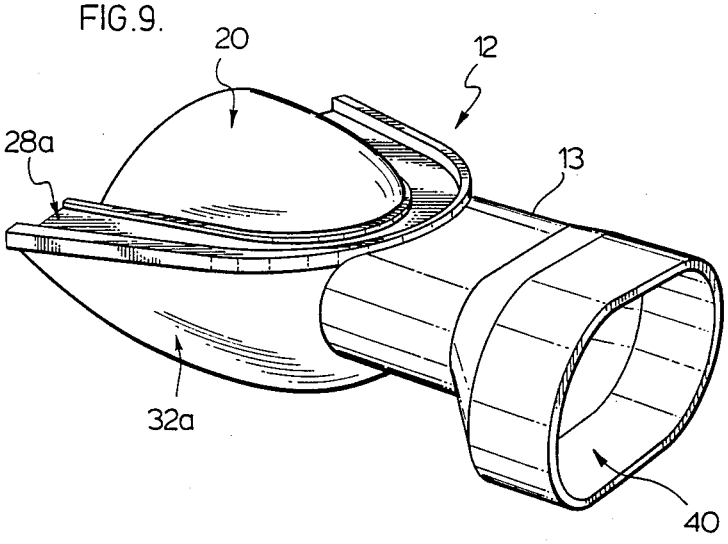
FIG. 9 is a perspective view of a preferred embodiment of the mouthpiece incorporating a tooth tray.
Figure 10:
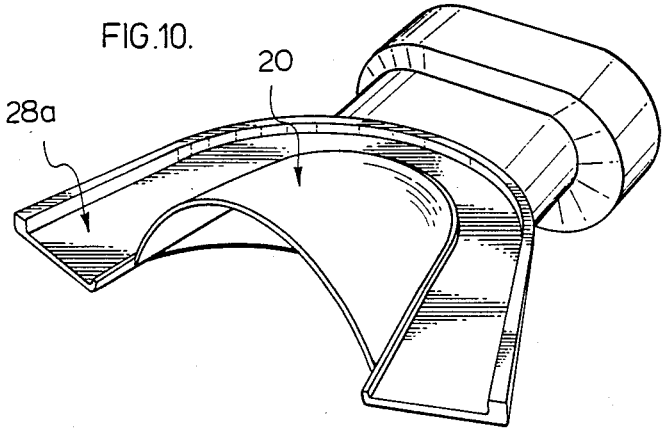
FIG. 10 is an alternative perspective of the mouthpiece in FIG. 9.
Figure 11:
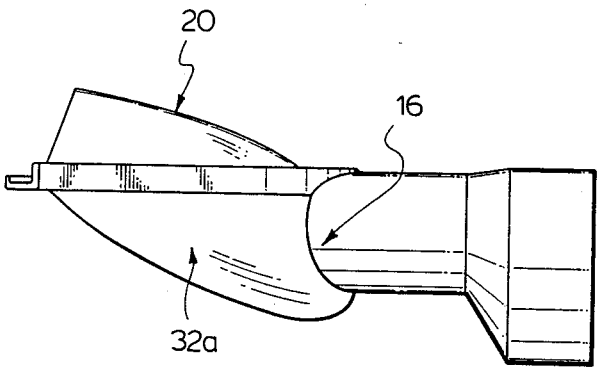
FIG. 11 is side view of the mouthpiece in FIG. 9, projecting the aspects of the mouthpiece in three (3) dimensions.
Figure 12:
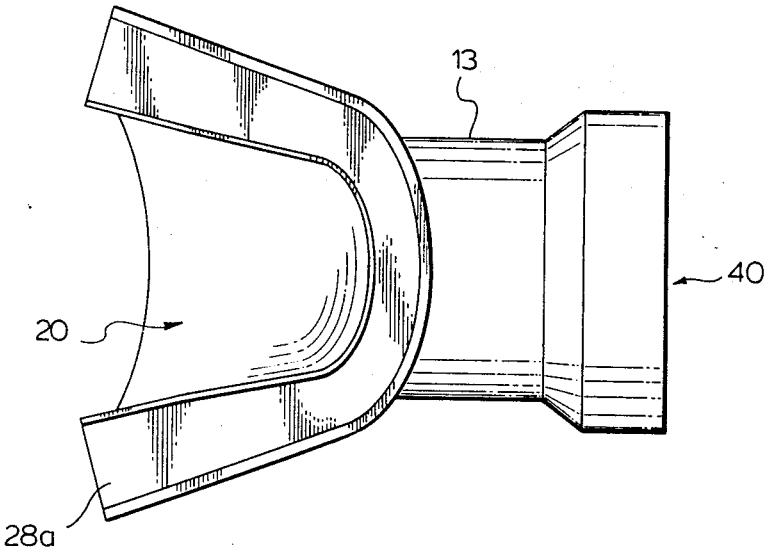
FIG. 12 is a top view of the mouthpiece in FIG. 9.

Referring to FIGS. 1, 4 and 8, in a preferred embodiment of the mouthpiece 43 (best seen in FIG. 8) a third opening 44 in the manifold 13 is provided for the passage of air through the chamber volume 14 between the second opening 40 in the manifold 13 and a naso-labial hood 46 for enveloping the nostrils 48. The naso-labial hood 46 is of a concave configuration to envelope the nose 50, comprising the nasal bone 52, the soft maxillary tissue on both sides of the nose 53 downward to the anterior face of the upper lip 56 below the nostrils 48, and the nostrils 48. Advantageously this provides a minimal volume of non-respiratory tract dead air space 49, ideal for applications involving testing of respiratory gases. The naso-labial hood 46 and the palatine hood 20 are integrated to establish a compressive elastic recoiling 58 between the two by means of a compressively sprung 58 metal frame 60 integrated into the material of the naso-labial hood 46, manifold 13, and palatine hood 20. Referring to FIG. 4, the recoiling 58 between the naso-labial hood 46 and the palatine hood 20 grips the soft tissue supported by the nasal bone 52 and maxillary bone 54. Advantageously, the naso-labial hood 46 and sealing flange 18 are thereby maintained in an intimate seal with the surrounding soft tissue without requiring any voluntary muscular effort or further external means for returning the mouthpiece 43 in place. The inspired and expired air may therefore only pass through the second opening 40 in the manifold 13.

With reference to FIGS. 9, 10, 11 and 12, here is shown a prototype of the mouthpiece 12. The embodiment shown comprises the same general configuration described with reference to FIGS. 2 through 8, whereby as a result of the sealing flange 18 extending from proximate the hard palate 22 to proximate the base of the lower vestibule portion of the mouth 38, the mouth may be open to the extent of the normal relaxed muscle tone of the mouth without the mouthpiece falling out and the mouth may be comfortably closed for swallowing, providing a mouthpiece 12 which is not dependant upon a bite plate for stability in the mouth. In the embodiment shown in FIGS. 9–12 an improved bite plate **28*a* comprises substantially a tooth tray which in combination with the palatine hood 20 provides an upper sealing tray, 28*a* and 20 lying congruently against the hard palate 22 and the posterior side of the upper teeth 24. The lower labial skirt 32*a* extends downwardly from the upper sealing tray 28*a*, 20 into the lower vestibule portion of the mouth 38 (best seen with reference to FIG. 1). In the embodiment shown the tooth tray 28*a* extends under the teeth and becomes the palatine hood 20, and in combination with the lower labial skirt 32*a*** provides a more effective seal.

A non-deformable model of the mouthpiece 12 may be provided, composed of urethane elastomer. For a formable model of the mouthpiece, it may be comprised of ethylene vinyl acetate permitting the mouthpiece 12 to be moulded to the configuration of the mouth of an individual. It will be appreciated that the mouthpiece 12 taught in the present invention is of a configuration suitable to conform to the natural configuration of the mouth. The formable model of the mouthpiece is preferred for providing the maximum benefits of the invention, since the formable mouthpiece is more comfortable and a better seal is achieved. Since it is not necessary to bite down on the mouthpiece to achieve this seal, the formable model made of ethylene vinyl acetate can be pliable in the mouth since the mouthpiece does not require a rigid bite plate having tensile strength so that it will not distort.

With reference to the embodiment of the naso-labial hood 46 shown in FIG. 4, preferably the peripheral portion of the naso-labial hood lying against the face including the nasal bone 52, the soft maxillary tissue on both sides of the nose 53 downward to the anterior face of the upper lip 56 below the nostrils 48 is composed of a sponge which may be infiltrated with a jell to facilitate the formation of an airtight seal.

As many changes can be made to the embodiments of the invention without departing from the scope of the invention, it is intended that all matter herein be interpreted as illustrative of the invention and not in a limiting sense.

The embodiments of the invention in which an exclusive property or privilege is claimed are as follows:

1. A mouthpiece through which a person may breathe consists essentially of a manifold having at least one first opening in the manifold, the manifold at the first opening extending to form a sealing flange for introduction into the mouth, the sealing flange comprising an upper palatine hood portion and a lower labial skirt portion, the palatine hood of a generally convex shape suitable to lie against the hard palate and the posterior side of the upper teeth extending laterally in both directions from proximate the central incisors to proximate the premolars inside the buccal cavity, the lower labial skirt of a generally concave shape suitable to lie between the posterior face of the lower lip and the anterior face of the lower gum and teeth extending laterally in both directions from proximate the central incisors to proximate the premolars inside the lower vestibule portion of the mouth, the peripheral shape of the upper palatine hood extending laterally from about its centre angularly downward on both sides to merge on both sides with the lateral limits of the lower labial skirt, the peripheral shape of the lower labial skirt extending laterally from about its centre upwardly to merge with the palatine hood such that the two laterally spaced areas of merger between the palatine hood and the lower labial skirt are at about the corners of the mouth when the sealing flange is introduced into the mouth; the manifold having at least a second opening for opening outside the mouth for the passage of inspired and expired air, the first opening and the second opening being in communication with one another through the manifold for the passage of air.

2. The mouthpiece of claim 1 wherein the sealing flange comprising an upper palatine hood the peripheral shape of which extends from about its centre angularly downward on both sides to its lateral limits where it merges, on both sides with the lateral limits of the lower labial skirt, the peripheral shape of the lower labial skirt extending laterally from about its centre upwardly to merge with the palatine hood; comprises at about the two laterally spaced areas of merger between the palatine hood and the lower labial skirt and extending across the lateral width of the sealing flange a tooth tray for extending under the upper teeth and merging with the upper palatine hood suitable to facilitate a seal proximate the upper portion of the mouth and to permit the mandible to close without displacing tissue or forcing the mouth open.

3. A breathing apparatus consists essentially of a manifold having at least one first opening in the manifold, the manifold at the first opening extending to form a sealing flange for introduction into the mouth, the sealing flange comprising an upper palatine hood portion and a lower labial skirt portion, the palatine hood of a generally convex shape suitable to lie against the hard palate and the posterior side of the upper teeth extending laterally in both directions from proximate the central incisors to proximate the premolars inside the buccal cavity, the lower labial skirt of a generally concave shape suitable to lie between the posterior face of the lower lip and the anterior face of the lower gums and teeth extending laterally in both directions from proximate the central incisors to proximate the premolars inside the lower vestibule portion of the mouth, the peripheral shape of the upper palatine hood extending laterally from about its centre angularly downward on both sides to merge on both sides with the lateral limits of the lower labial skirt, the peripheral shape of the lower labial skirt extending laterally from about its centre upwardly to merge with the palatine hood such that the two laterally spaced areas of merger between the palatine hood and the lower labial skirt are at about the corners of the mouth when the sealing flange is introduced into the mouth; at least a second opening in the manifold for opening outside the mouth for the passage of inspired and expired air, the first opening and the second opening being in communication with one another through the manifold for the passage of air; and, at least a third opening in the manifold for the passage of air between the manifold and a naso-labial hood for enveloping the nostrils, the naso-labial hood presenting a generally concave cavity to envelop the nose and of a peripheral shape to lie against the outline of the nose comprising the nasal bony cartilage, the nasal bone, and the maxillary soft tissue on both sides of the nose downwardly to the anterior face of the upper lip below the nostrils.

4. The mouthpiece of claim 3 wherein the sealing flange comprising an upper palatine hood the peripheral shape of which extends from about its centre angularly downward on both sides to its lateral limits where it merges, on both sides with the lateral limits of the lower labial skirt, the peripheral shape of the lower labial skirt extending laterally from about its centre upwardly to merge with the palatine hood; comprises at about the two laterally spaced areas of merger between the palatine hood and the lower labial skirt and extending across the lateral width of the sealing flange a tooth tray for extending under the upper teeth and merging with the upper palatine hood suitable to facilitate a seal proximate the upper portion of the mouth and to permit the mandible to close without displacing tissue or forcing the mouth open.

5. The breathing apparatus of claim 3 wherein the naso-labial hood is integrated with the palatine hood through the body of the breathing apparatus to provide an elastic recoiling between the naso-labial hood and the palatine hood sufficient for the device to form a compressive grip about the soft tissue defined on one side by the exterior surface of the nose including the nasal bony cartilage, the nasal bone, the maxillary soft tissue on both sides of the nose downwardly to the anterior face of the upper lip and defined on the opposing side by the hard palate supported by the maxillary bone.

6. The breathing apparatus of claim 4 wherein the naso-labial hood is integrated with the palatine hood through the body of the breathing apparatus to provide an elastic recoiling between the naso-labial hood and the palatine hood sufficient for the device to form a compressive grip about the soft tissue defined on one side by the exterior surface of the nose including the nasal bony cartilage, the nasal bone, the maxillary soft tissue on both sides of the nose downwardly to the anterior face of the upper lip and defined on the opposing side by the hard palate supported by the maxillary bone.

7. The breathing apparatus of claim 2 wherein the tooth tray is of a thickness not exceeding about 0.5 millimeters, suitable to permit the mandible to close without displacing tissue or forcing the mouth open.

8. The breathing apparatus of claim 4 wherein the tooth tray is of a thickness not exceeding about 0.5 millimeters, suitable to permit the mandible to close without displacing tissue or forcing the mouth open.

9. The breathing apparatus of claim 5 wherein the naso-labial hood and the palatine hood are integrated to establish a compressive elastic recoiling between the two by means of a resiliently deformable frame integrated into the breathing apparatus.

10. The breathing apparatus of claim 6 wherein the naso-labial hood and the palatine hood are integrated to establish a compressive elastic recoiling between the two by means of a resiliently deformable frame integrated into the breathing apparatus.

11. The breathing apparatus of claim 9 wherein the resiliently deformable frame comprises a compressively sprung clip integrated into the body of the naso-labial hood, manifold, and palatine hood to form opposing compressively sprung arms of the clip in the naso-labial hood and palatine hood sufficient to cause the naso-labial hood and the palatine hood to recoil one towards the other.

12. A mouthpiece through which a person may breathe when the mouthpiece is introduced into the mouth which is adapted to remain in the mouth when it is open to the extent of the normal relaxed muscle tone of the mouth and to permit the comfortable closing of the mouth when the mouthpiece is in place, the mouthpiece consisting essentially of: (a) a manifold having at least one first opening in the manifold, the manifold at the first opening extending to form a sealing flange for introduction into the mouth, whereby when the sealing flange is introduced into the mouth the said first opening is spaced on the anterior side of the teeth; (b) the sealing flange comprising an upper palatine hood portion of a configuration suitable to conform to the upper surface of the hard palate and a lower labial skirt portion of a configuration suitable to conform to the lower vestibule portion of the mouth intermediate the posterior face of the lower lip and the anterior face of about the lower gum and teeth; (c) the manifold having at least a second opening for opening outside the mouth for the passage of inspired and expired air, the first opening and the second opening being in communication with one another through the manifold for the passage of air; and (d) whereby the sealing flange of (b) is comfortably held in place by the juxtaposition in the mouth of the upper palatine hood portion of the sealing flange against the hard palate and the lower labial skirt portion of the sealing flange seated in the lower vestibule portion of the mouth.

13. The breathing apparatus of claim 12 wherein the sealing flange comprises a tooth tray intermediate the upper palatine hood portion of the sealing flange and the lower labial skirt portion of the sealing flange, whereby the tooth tray merges with the upper palatine hood portion to facilitate a seal proximate the upper portion of the mouth.

14. The breathing apparatus of claim 12 wherein the manifold comprises at least a third opening for the passage of air between the manifold and means for enveloping the nostrils.

15. The breathing apparatus of claim 14 wherein the means for enveloping the nostrils comprises a nasolabial hood presenting a generally concave cavity to envelop the nose and of a peripheral shape to lie against the outline of the nose comprising the nasal bony cartilage, the nasal bone, and the maxillary soft tissue on both sides of the nose downwardly to the anterior face of the upper lip below the nostrils.

* * * * *